US006650830B2

(12) United States Patent
Kerec

(10) Patent No.: US 6,650,830 B2
(45) Date of Patent: Nov. 18, 2003

(54) EXTENDABLE HEATER

(75) Inventor: Nancy Kerec, Quebec (CA)

(73) Assignee: Societe en Commandite Gaz Metropolitain, Montreal (CA)

( * ) Notice: Subject to any disclaimer, the term of this patent is extended or adjusted under 35 U.S.C. 154(b) by 0 days.

(21) Appl. No.: 09/996,351

(22) Filed: Nov. 28, 2001

(65) Prior Publication Data

US 2003/0099468 A1 May 29, 2003

(51) Int. Cl.[7] ..... H05B 3/00; F24D 13/00

(52) U.S. Cl. ..... 392/430; 392/431; 219/520; 126/85 R

(58) Field of Search ..... 392/370, 430, 392/431, 374; 126/85 R; 219/520, 523, 533, 536, 522, 524, 202, 203

(56) References Cited

U.S. PATENT DOCUMENTS

| | | | | | |
|---|---|---|---|---|---|
| 2,795,683 | A | * | 6/1957 | Teiger | 219/522 |
| 4,140,100 | A | | 2/1979 | Ishihara | 126/92 B |
| 4,159,411 | A | | 6/1979 | Ellersick | 219/346 |
| 4,319,125 | A | | 3/1982 | Prince | 219/347 |
| 4,354,479 | A | | 10/1982 | Haruhara | 126/92 |
| D282,202 | S | | 1/1986 | Ellersick | D23/77 |
| D325,963 | S | | 5/1992 | Anderson | D23/332 |
| 5,243,682 | A | * | 9/1993 | Eberts | 392/370 |
| 5,621,846 | A | | 4/1997 | Smith et al. | 392/376 |
| D379,650 | S | | 6/1997 | Smith et al. | D23/335 |
| 5,659,657 | A | * | 8/1997 | Overdorf | 219/524 |
| 5,844,202 | A | * | 12/1998 | Alverson | 219/520 |
| 5,964,233 | A | | 10/1999 | Clark et al. | 135/16 |
| D429,324 | S | | 8/2000 | Olson et al. | D23/342 |
| 6,102,031 | A | | 8/2000 | Waters | 126/92 AC |
| 6,122,437 | A | | 9/2000 | Johnson | 392/376 |
| 6,188,836 | B1 | | 2/2001 | Glucksman et al. | 392/376 |

FOREIGN PATENT DOCUMENTS

| | | | |
|---|---|---|---|
| EP | 1 039 218 A1 | | 9/2000 |
| GB | 2 300 044 | * | 10/1996 |
| WO | WO 97/01735 | | 1/1997 |
| WO | WO 00/08965 | | 2/2000 |

* cited by examiner

*Primary Examiner*—Tu Ba Hoang
(74) *Attorney, Agent, or Firm*—Darby & Darby

(57) ABSTRACT

Disclosed herein is a heater comprising a wall-engaging member mountable to a wall, an extendable arm including proximate and distal ends. The proximate end being mounted to the wall-engaging member. The heater also includes a heat projecting heater-head mounted to the distal end of the extendable arm. Wherein the heater-head is reciprocally movable between a first position where the heater-head is in close proximity to the wall-engaging member and a second position where the heater-head is distant from the wall-engaging member.

28 Claims, 6 Drawing Sheets

EXTENDABLE HEATER

FIELD OF THE INVENTION

The present invention relates to a heater. More specifically, the present invention is concerned with an extendable heater mountable to a wall.

BACKGROUND OF THE INVENTION

Radiant heaters are well known and used to provide heat to selected areas of a given space. These heaters may be used to heat spaces such as workshops, patios, terraces and the like. Some of the conventional portable heaters include a flat platform to be placed on the floor of the given space and having a leg upstanding therefrom, the leg carries a heater or heater-head on its top portion for transmitting radiated heat to the selected area. Other heaters may be mounted to the ceiling, s till others may be fixedly mounted to a wall surface.

A drawback of the prior art heaters is t hat they often direct heat to a limited area. In the case of portable heaters, the leg and platform arrangement limits the space surrounding the heater-head hence, not all objects that are to be heated can be brought in close proximity to he heater-head. Hence, these heaters must be placed close to the area to be heated.

There thus remains a need to provide a heater that can transmit heat to a greater area.

OBJECTS OF THE INVENTION

The general object of the present invention is therefore to provide an improved heater.

SUMMARY OF THE INVENTION

More specifically, in accordance with the present invention, there is provided a heater comprising:

a wall-engaging member mountable to a wall;

an extendable arm including proximate and distal ends, the proximate end being mounted to the wall-engaging member; and a heater-head being mounted to the distal end of the extendable arm;

wherein the heater-head is reciprocally movable between a first position where the heater-head is in close proximity to the wall-engaging member and a second position where the heater-head is distant from the wall-engaging member.

In accordance with another aspect of the present invention, there is provided an extendable heater comprising:

a proximal section having a proximate end including a wall-engaging member mountable to a wall, and a distal end; and a distal section including a heater-head for projecting heat, the distal section moveably mounted to the distal end of the proximate section, wherein the heater-head is reciprocally movable between a first position wherein the heater-head is in close proximity to the wall-engaging member and a second position wherein the heater-head is distant from the wall-engaging member.

In accordance with a further aspect of the present invention, there is provided a heater comprising:

a wall-engaging member mountable to a wall;

an extendable accordion arm having proximate and distal ends, the proximate end of the extendable accordion arm being mounted to the wall-engaging member; and a heater-head mounted to the distal end of the extendable accordion arm.

In accordance with a yet another aspect of the present invention, there is a support for a heater comprising:

a wall-engaging member mountable to a wall; and an extendable arm including proximate and distal ends, the proximate end being mounted to the wall-engaging member, the distal end being so configured as to receive the heater, wherein the extendable arm is reciprocally movable between a first position wherein the extendable arm is fully retracted and a second position wherein the arm is fully extended.

In accordance with yet a further aspect of the present invention, there is provided a heater comprising:

extendable means having a proximate end and a distal end;

means for mounting the proximate end to a wall surface;

heat generating means mounted to the distal end;

wherein the extendable means being so designed as to reciprocally move the heat generating means between a first position wherein the heat generating means are in close proximity to the mounting means and a second position wherein the heat generating means are distant from the mounting means.

It is to be understood that the term "wall" can be construed herein as any substantially vertical surface on which a wall engaging member can be mounted to. It must also be noted that the terms "first" and "second" are used herein throughout for convenience only so as to facilitate the present description and hence, are interchangeable.

Other objects, advantages and features of the present invention will become more apparent upon reading of the following non restrictive description of preferred embodiments thereof, given by way of example only with reference to the accompanying drawings.

BRIEF DESCRIPTION OF THE DRAWINGS

In the appended drawings, like numbers refer to like elements throughout and in which:

FIG. 9 is a perspective view of the extendable heater of FIG. 5, mounted to a wall in a schematic patio setting.

DESCRIPTION OF PREFERRED EMBODIMENTS

With reference to the appended drawings preferred embodiments of the present invention will be described herein.

Figure 1:
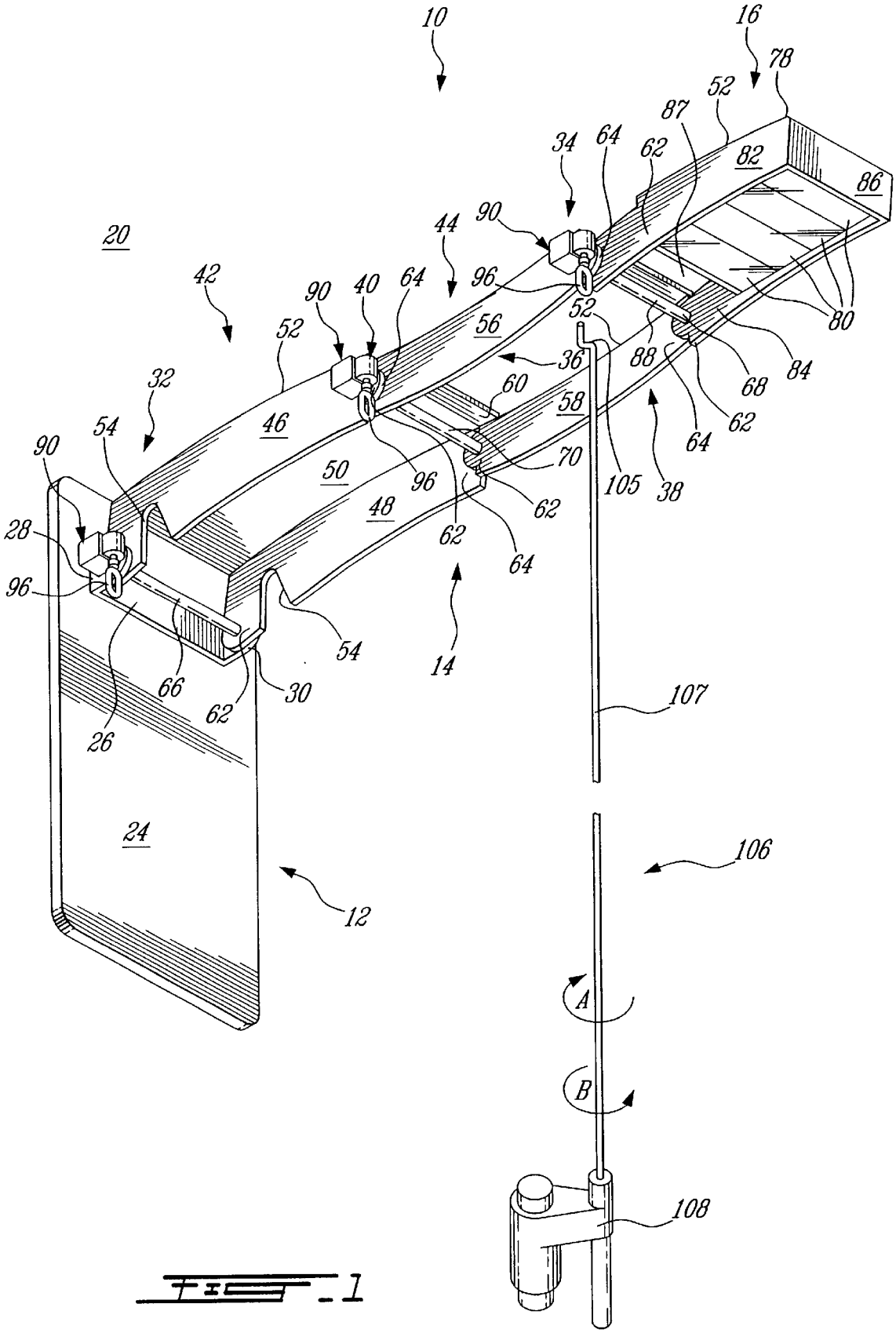
FIG. 1 is a perspective view of an extendable heater in accordance with one embodiment of the present invention, shown in a fully extended position.

FIG. 1 shows a first embodiment of an extendable heater 10 comprising a wall-engaging member 12, an extendable member 14 and a heater-head 16.

As shown, the extendable member 14 consists of an extendable arm provided between the wall-engaging member 12 and the heater head 16.

The wall-engaging member 12 is designed to be mounted to a wall surface 20.

In the embodiment of FIGS. 1 to 4, the wall-engaging member 12 has a wall-engaging portion in the form of body 24 and an arm-receiving portion in the form of a generally U-shaped bracket 26 mounted to the body 24.

The bracket 26 includes first and second arms 28 and 30 each having an aperture (not shown). The bracket 26 is thus configured to receive the extendable arm 14 as will be explained below.

The body 24 is a large rectangular piece that can be made of metal or any other suitable material.

The extendable arm 14 has an accordion like structure providing it with the ability to extend and retract. The extendable arm 14 includes proximate and distal ends 32 and 34, respectively and first and second sides 36 and 38, respectively.

The proximate end 32 is advantageously pivotally mounted to the bracket 26 of the wall-engaging member 12 while the heater-head 16 is pivotally mounted to the distal end 34.

The extendable arm 14 includes a pivot joint 40 that divides the arm 14 into arm sections such as proximate and distal arm sections 42 and 44, respectively. Hence, the arm sections 42 and 44 are pivotally interconnected at the pivot joint 40 with the proximate arm section 42 being mounted to the wall-engaging member 12 and the distal arm section being mounted to the heater-head 16.

Each arm section 42 and 44 includes a pair of substantially parallel and interconnected longitudinal members.

More specifically, the proximate arm section 42 includes a pair of similar longitudinal members 46 and 48, interconnected at the proximate end 32 (as will be discussed below) and at joint 40. A top member or cover 50 (see also FIGS. 2, 3 and 4) is mounted to the top edges 52 of members 46 and 48. This top cover 50 also stabilizes members 46 and 48. As will be explained further below, members 46 and 48 include respective grooves 54 near the proximal end 32.

As shown in FIG. 1, the distal arm section 44 includes a pair of similar longitudinal members 56 and 58. The distal section members 56 and 58 are interconnected at joint 40 and at the distal end 34 (as will be discussed below). Furthermore, members 56 and 58 are interconnected by a top member consisting of a strip member 60 at their top edges 52 to stabilize members 56 and 58.

As will be discussed below the longitudinal members 46, 48, 56 and 58 have a curved configuration. Also, each member of a pair of longitudinal members is on a respective arm side 36 and 38. Each member 46, 48, 56 and 58 has respective first and second ends 62 and 64, respectively, with each end 62 and 64 having a respective aperture (as will be discussed below). These longitudinal members are made of a metallic, plastic or other strong and durable material.

The distal end 32 includes a pivot member such as pivot rod 66 inserted in the apertures of the bracket 26 and of the members 46 and 48. In the example shown here, the pivot rod 66 hingeably connects the proximate end 32 to the bracket 26. Specifically, the first end 62 of member 46 is mounted to the first bracket arm 28 with their respective apertures being aligned so as to be hinged together by the pivot rod 66. Similarly, the first end 62 of member 48 is mounted to the second bracket arm 30 with their respective apertures being aligned so as to be hinged together by the pivot rod 66. In this way, the proximate end 32 may be pivoted about a pivot axis defined by pivot rod 66. Hence, the proximate end 32 may be considered a pivot joint.

The pivot joint 40 includes a pivot member in the form of a pivot rod 70.

Specifically, pivot joint 40 is formed by the second ends 64 of distal arm section 42 being mounted to the first end 62 of distal arm section 44 with their respective apertures being aligned so as to be hinged together by the pivot rod 70.

In this way, the proximate and distal arm sections 42 and 44 are pivotable about a pivot axis defined by pivot rod 70.

The heater-head is shown pivotally mounted to the distal end 34. Hence, the wall-engaging member 12 and the extendable arm 14 may be considered as a support for the heater-head 16.

In the non-imitative example shown in FIGS. 1 to 4, the heater-head 16 has a generally longitudinal configuration and includes a housing 78 carrying heating elements 80.

The housing 78 is formed of two longitudinal members 82 and 84, each at a respective arm side 36 and 38, and a frontal member 86. The longitudinal members 82 and 84 are similar to longitudinal members 46, 48, 56 and 58 and as such have respective first and second ends 62 and 64 as well as a curved configuration. The first ends of members 82 and 84 have respective aperture (not shown) which act as arm-receiving portions. Longitudinal members 82 and 84 are joined together at their second ends 64 via the frontal member 86, mounted therebetween. A top member or cover 87 is also mounted between members 82 and 84 at their top edges 52. In this way, members 82, 84, 86 and 87 enclose the heating elements 80.

The distal end 34 includes a pivot member in the form of a pivot rod 88. Specifically, the second ends 64 of the distal arm section 44 is so mounted to the first end 62 of the heater head 16 as to be hinged together by the pivot rod 88. In this way, the heater-head 16 and the distal arm section 44 are pivotable about a pivot axis defined by the pivot rod 88. Hence, the distal end 34 may be considered a pivot joint.

It is to be noted that the rod 66 is fixedly mounted to the proximate end of the arm section 42 and rotatably mounted to the bracket 26; the rod 70 is fixedly mounted to the proximate end of the arm section 44 and rotatably mounted to the arm section 42; and the rod 88 is fixedly mounted to the proximate end of the hater head 16and rotatably mounted to the arm section 44.

As shown, each pivot joint 32, 34 and 40 is advantageously provided with a respective actuating assembly 90.

Figure 4:
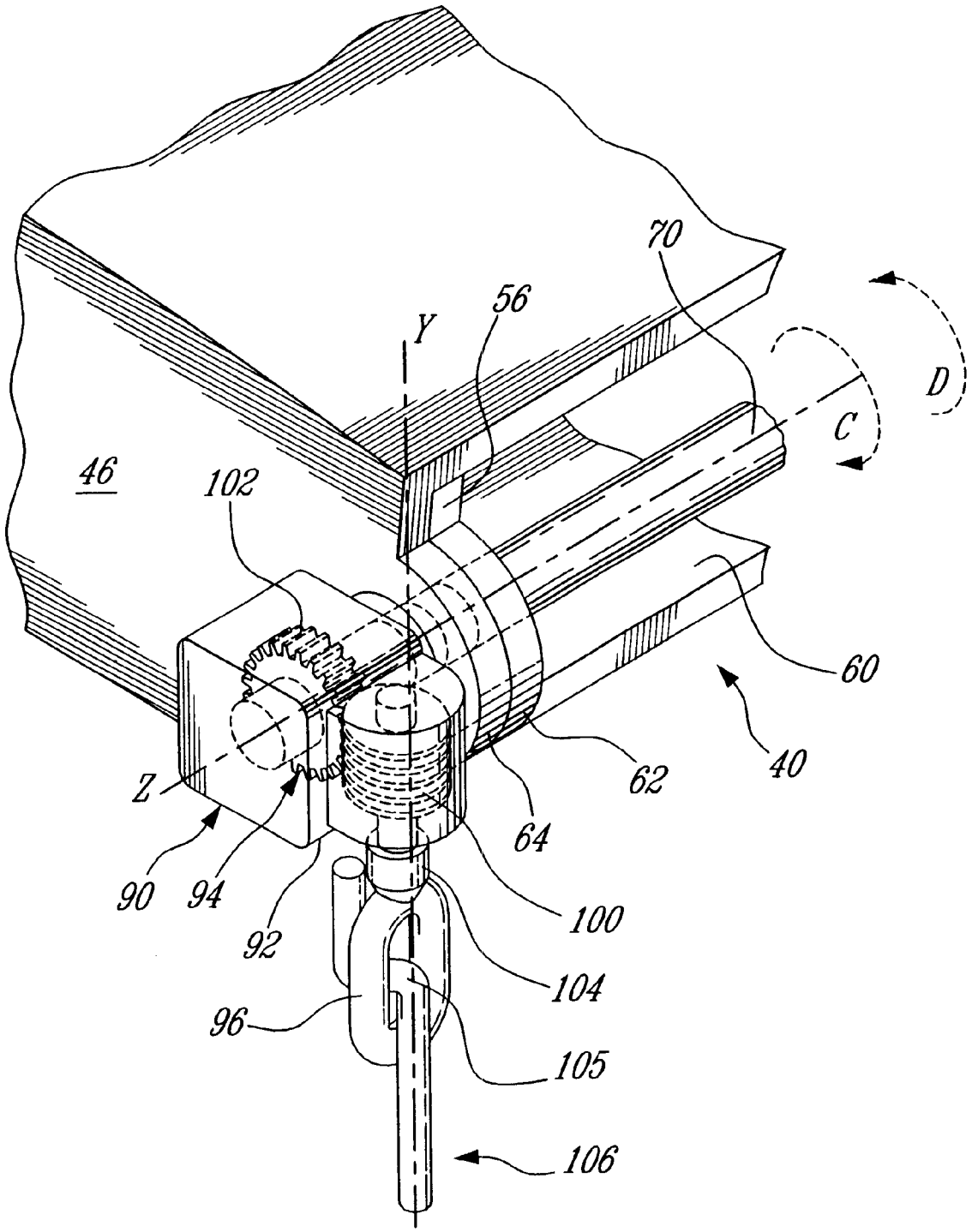
FIG. 4 is a perspective view of a portion of the extendable heater of FIG. 1 revealing the actuating assembly.

Turning to FIG. 4, each actuating assembly 90 includes a housing 92 in which an actuating mechanism 94 is mounted and a pivot key 96.

The actuating mechanism 94 includes a worm gear 100 and a pinion gear 102 in mutual interference engagement. The pivot key 96 is mounted to the worm gear 100 by way of a bolt assembly 104, for example, so that rotation of the ring 96 causes rotation of the gear 100. Similarly, the pinion gear 102 is so mounted to a respective pivot rod, such as pivot rod 70 in this illustrated example, that rotation of the pinion 102 causes rotation of the pivot rod.

The pivot key 96 is provided in the form of a ring to receive, for example, a complementary hook member 105 of a pivot shaft assembly 106 (see FIG. 1).

This pivot shaft assembly 106 includes a pivot shaft 107 having the hook member 105 on its distal end and a handle 108 at its proximate end. The handle may be a mechanical handle that is manually operated or a motorized handle than can spin the shaft 107 by pressing a switch (not shown), for example.

With reference to FIGS. 1 to 4, the operation of the extendable heater 10 will now be described.

The arm 14 is moveable by pivoting its arm sections 42 and 44 about pivot joint 40.

Figure 2:
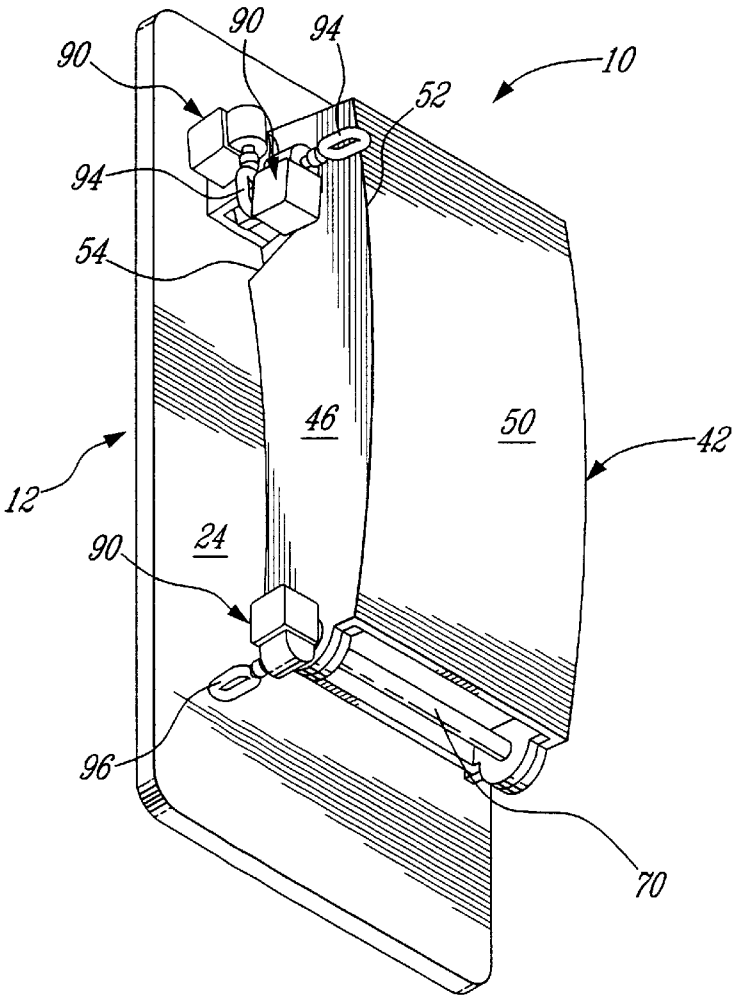
FIG. 2 is a perspective view of the extendable heater of FIG. 1 in a fully retracted position.

In this respect, the heater-head 16 is reciprocally moveable between a fully retracted position illustrated in FIG. 2 and a fully extended position illustrated in FIG. 1.

In the fully retracted first position shown in FIG. 2, the extendable arm 14 is fully retracted or folded and the heater-head 16 is in close proximity to the wall-engaging member 12. Usually the heater 10 is in this retracted position when not in use. This position along with the configuration of the heater-head housing 78 is convenient since the heating elements 80 are boxed therein and, as will be described, the housing 78 is boxed within the distal arm section 44. In this way, the heating elements 70 are protected from adverse weather conditions, vandalism and the like. Furthermore, a box container (not shown) may be mounted to the wall-engaging member 12 or wall 20 to fully surround the heater 10 and may have a front door (not shown) to close in the extendable heater 10. This container may also be provided with a pad or combination lock to secure the heater 10 therein. An alarm system attached to the locking may also be provided.

In the fully extended position shown in FIG. 1, the extendable arm 14 is fully extended and the heater-head 16 is at the greatest possible distance away from the wall-engaging member 12. Of course, the foregoing distance will vary in accordance with the configuration and length of arm 14, which is dependent on the length of the longitudinal members and the number of arm sections.

In order to move the heater-head 16 between the first and second positions the user will pivot the pivot joints 32, 34 and 40 about their respective pivot rods 66, 70 and 88. The user utilizes the pivot shaft assembly 106 to turn the pivoting key 96 on a given pivot joint 32, 34 and 40.

With particular reference to FIG. 4 the user engages the pivot key 96 with the hook member 105 of the pivot shaft assembly 106. Using the handle 108 the user manually or by way of motor turns the shaft 107 about its vertical axis Y causing the key 96 to turn therewith. This causes the worm gear 100 to also turn about the Y axis so as to act on the pinion gear 102 which will turn along with rod 70 (in the specific example of FIG. 4) about the pivot axis Z defined by pivot rod 70. Of course, the foregoing is applicable to the pivoting of rods 66 and 88.

Shaft 105 can either be turned in clockwise or counter-clockwise directions as respectively shown by arrows A and B in FIG. 1. This depends on whether the user wishes to ultimately pivot a given rod 66, 70 or 88 in a forward or backward direction as respectively shown by arrows C and D in FIG. 2. Therefore, in the non-limiting example shown here, turning a given pivot key 96 in the clockwise direction A, results in pivoting a respective pivot rod 66, 70 or 88 in the backward direction D, causing the extension of the heater. Alternatively, turning a given pivot key 96 in the counter-clockwise direction B, results in pivoting a given pivot rod 66, 70 or 88 in the forward direction C, causing the retraction of the heater. It should be noted that the foregoing forward and backward pivoting movements of rods 66, 70 and 88 are dependant on the configuration of the gears 100 and 102 and their mutual interaction.

It will easily be understood by one skilled in the art that the rods 66, 70 and 88 are actuated by respective actuating assemblies 90 in sequence to uncoil the extendable heater 10 and in reverse sequence to coil the heater 10.

Figure 3:
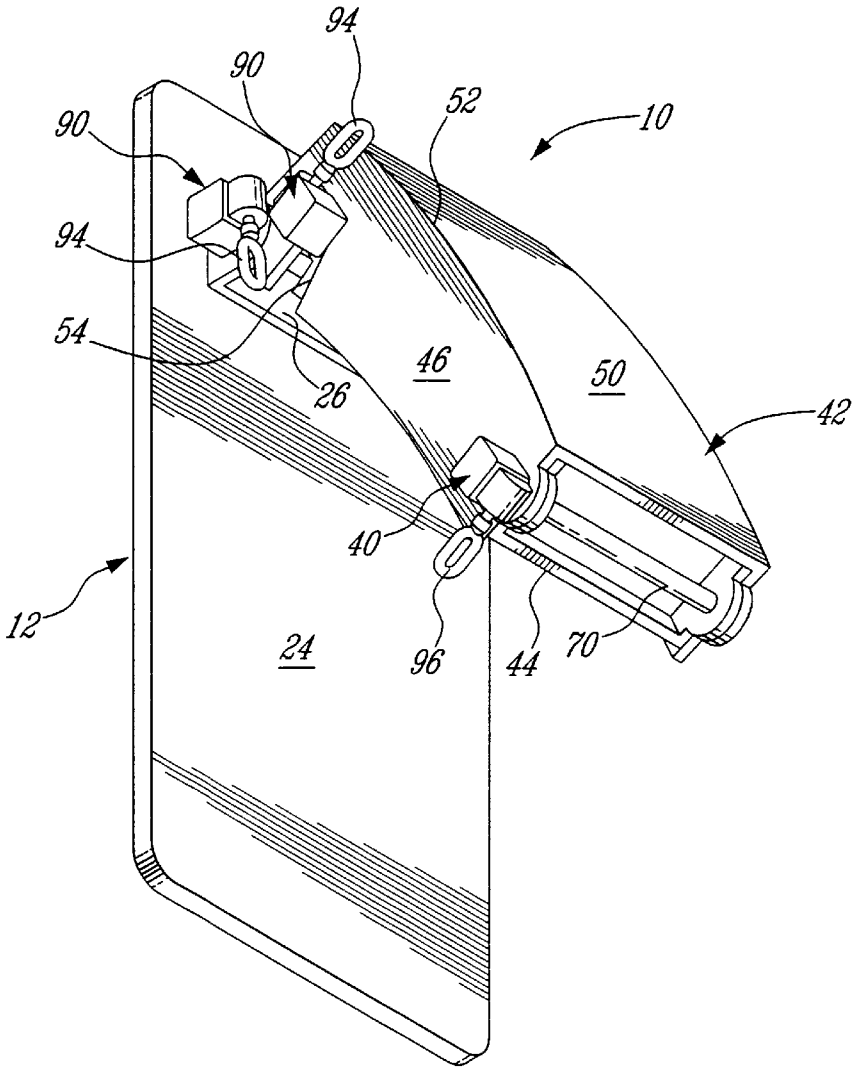
FIG. 3 is a perspective view of the extendable heater of FIG. 1 in a partially extended position.

It will also be noted that the grooves 54 are provided to allow the actuating assembly 90 associated with the pivot rod 88 therein in the retracted positions (see FIGS. 2 and 3).

The proximate arm section members 46 and 48 are wide and long enough to box in both arm section 44 and the heater-head 16. The curved configuration of the longitudinal members 46, 48, 56, 58, 82 and 44 as well as the space between each pair of longitudinal members provide for the heater 10 to be easily folded or recoiled.

In order to maintain the present extendable heater 10 in position, such as the ones depicted in FIG. 1 or 3, tension rings (not shown) may be mounted to each pivot rod 32, 34 and 40 and at each of the pivot rod ends. Of course other ways of maintaining the pivot joints 32, 34 and 40 in position may also be contemplated within the scope of the present invention.

It is also to be noted that while the appended drawings show the heater head 16 in a position generally parallel to the ground, the heater head 16 may be positioned in other suitable and desirable positions. The heater-head may be pivoted about the distal end 34 to radiate heat in different directions.

With respect to the above-described embodiment, what follows is a brief description of some alternative features that are included, without limitation, within the scope of the present invention.

Referring to the wall-engaging member 12, it should be noted that the body 24 may be provided in a variety of suitable shapes. Furthermore, the wall-engaging member 12 may include only the bracket 26. In this case, it is the bracket that is directly mounted to the wall surface 20. Also, proximate end 32 may be directly mounted to the wall surface 20 and in this case the proximate end 32 may be considered to be a wall-engaging member.

With respect to the arm 14, it should be noted that a greater number of joints will provide for a greater number of arm sections. Furthermore, members 56 and 58 are interconnected by one or more top members of strips 60 at their top edges 52. In fact this strip 60 may cover the whole top length of arm section 44. Of course, it may be contemplated that the arm 14 does not include a cover 50, nor a strip 60.

The arm 14 may be pivotally mounted to the wall-engaging member 12 by a variety of suitable ways known to the skilled artisan.

With reference to the heater-head 16, it is to be understood that it may be provided in a wide variety of suitable configurations and sizes. The heating elements 80 may be mounted to the housing 68 by a variety of conventional ways. The heating elements 70 may include a variety of types known in the art.

The heater-head 16 may include of variety of conventional heaters that are mounted or mountable to the distal end 30. Of course, the heater-head 16 may be pivotally mounted to the distal end 34 by a variety of conventional ways.

In one embodiment, the heater-head may be a gas heater. In this way, the heater-head 16 may be connected to a gas supply (not shown) via a flexible gas pipe or tube (not shown). In one example, this tube may be connected along the longitudinal members via brackets. The gas supply may be provided with a control such as a knob, a lever, a switch and the like to control the flow of gas being sent to the heater-head 16.

In another embodiment, the heater-head 16 may be an electric heater. In this way, heater-head 16 may be connected to an electric power supply (not shown) via a wire (not shown). For example, the wire may be connected along the longitudinal members via brackets; the wire may then be connected to a switch assembly (not shown) which can be mounted to or housed in the wall-engaging member 12, or mounted to or housed in the wall 20. In another non-illustrated example, arm sections 40, may comprise tubular sections for fitting the wire therein.

Of course, other numerous ways, known in the art, to power the heater-head 16 may also be contemplated within the scope of the present invention.

With respect to the pivot assemblies 90, other types of pivot assemblies known in the art may also be contemplated within the scope of the invention such as a universal joint assembly or even a motorized actuating assembly to give just two examples. In the case of motorized pivot assemblies each assembly at each joint 32, 34 and 40 may be interconnected to a wire which is connected to a power source that may be mounted to the wall-engaging member 12 or mounted or even housed within the wall 20, a power switch (not shown) can be used to operate the motorized pivot assemblies, simultaneously or in sequence.

Turning now to FIGS. 5 to 9 another embodiment of the present invention will be described.

Figure 5:
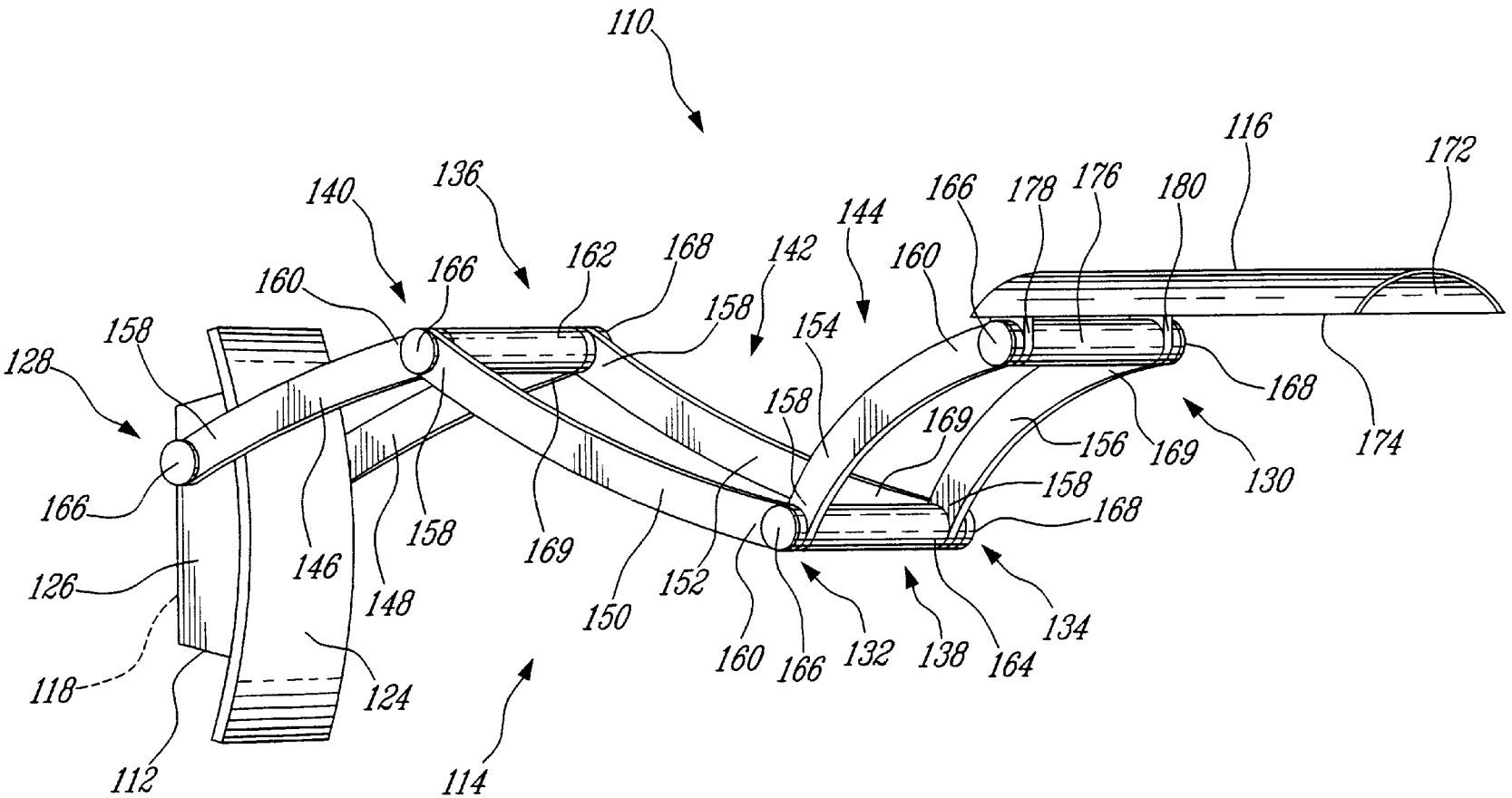
FIG. 5 is a perspective view of an extendable heater in accordance with a second embodiment of the present invention.

FIG. 5 shows an extendable heater 110 comprising a wall-engaging member 112, an extendable member 114 and a heater-head 116.

Again, the extendable member is extendable arm 114 provided between the wall-engaging member 112 and the heater head 16.

The wall engaging member 112 includes a wall-engaging portion in the form of a wall-engaging side 118 for engaging a wall surface 120 (see FIG. 9) such as the outer house wall in a patio setting 122 as shown in FIG. 9, for example. In this example, the wall-engaging member 112 has inner and outer body portions 124 and 126, respectively. The second or outer body portion 126 is configured to receive the extendable arm 114, as will be explained below.

The extendable arm 114 includes proximate and distal ends 128 and 130, respectively and first and second sides 132 and 134, respectively.

The proximate end 128 is pivotally mounted to the wall-engaging member 112 and the heater-head 116 is pivotally mounted to the distal end 130.

The extendable accordion arm 114 includes two pivot joints, 136 and 138 that divide the arm 114 into arm sections, such as proximate, medial and distal arm sections 140, 142 and 144, respectively.

Figure 6:
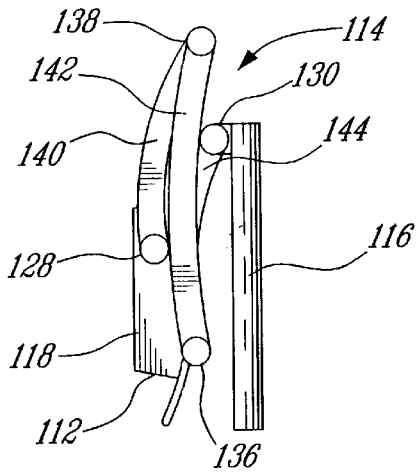
FIG. 6 is a side elevational view of the extendable heater of FIG. 5, shown in a fully retracted position.

The extendable accordion arm 114 has at least two arm sections interconnected via a pivot joint with one arm section being mounted to the wall-engaging member 112, such as the proximate arm section 140 in FIG. 5, and another arm section being mounted to the heater-head 116, such as the distal arm section 144 in FIG. 6.

Each arm section 140, 142 and 144 includes a pair of substantially parallel and interconnected longitudinal members. More specifically, the proximate arm section 140 includes a pair of similar longitudinal members 146 and 148; the medial arm section 142 includes a pair of similar longitudinal members 150 and 152; and the distal arm section 144 includes a pair of similar longitudinal members 154 and 156.

Each member of a pair of longitudinal members is on a respective arm side 132 and 134. The proximate section members 146 and 148 are interconnected at the proximate end 128 (as will be discussed below) and at pivot joint 136; the medial section members 150 and 152 are interconnected at pivot joints 136 and 138; and the distal section members 154 and 156 are interconnected at joint 138 and are interconnected at the distal end 130 (as will be discussed below). Each member 146, 148, 150, 152, 154, and 156 has respective first 158 and second 160 ends with each end 158 and 160 having a respective aperture (not shown).

As will be explained below the proximate arm section 140 is hingeably connected to the medial arm section 142 at pivot joint 136 and the medial arm section 142 is hingeably connected to the distal arm section 144 at pivot joint 138.

Each pivot joint 136 and 138 includes respective pivot members such as pivot rods 162 and 164 respectively. Each pivot rod 162 and 164 has first and second ends 166 and 168 at each arm side 132 and 134 respectively.

Specifically, pivot joint 136 is formed by the second end 160 of member 146 being mounted to the first end 158 of member 150 with their respective apertures being aligned so as to be hinged together by the first end 166 of pivot rod 162. Similarly, the second end 160 of member 148 is mounted to the first end 158 of member 152 with their respective apertures being aligned so as to be hinged by the second end 168 of pivot rod 162.

The pivot joint 138 is constructed in the same fashion hence, the second end 160 of member 150 is mounted to the first end 158 of member 154 with their respective apertures being aligned so as to be hinged together by the first end 166 of pivot rod 164. As before, second end 160 of member 152 is mounted to the first end 158 of member 156 with their respective apertures being aligned so as to be hinged together by the second end 168 of pivot rod 164.

Of course, it is within the scope of the present invention that pivot joints 136 and 138 may be constructed in other conventional and suitable ways as is known in the art.

The proximate end 128 is pivotally mounted to the wall-engaging member 112.

In this respect, the distal end 128 includes a pivot member such as pivot rod (not shown) which is similar to pivot rods 162 and 164. This pivot rod is journalled in the inner body portion 126 of the wall-engaging member 112 through an arm-receiving portion such as a longitudinal aperture (not shown) perforating the inner body portion. The first 166 and second (not shown) ends of the pivot rod protrude the longitudinal aperture and are respectively pivotally mounted the first ends 158 the of longitudinal members 146 and 148 through their respective apertures (the second end of member 148 is not shown) hence, hinging the proximate end 128 to the inner body portion 126. In this way, the proximate end 128 is pivotable about a pivot axis defined by this above-mentioned pivot rod.

As before, the heater-head 116 may be a conventional gas or electric heater being mounted or mountable to the distal end 130.

In the non-imitative example shown here, heater-head 116 includes a housing 172 and a heat-transmitting underside 174 for transmitting heat to an object which is desired to be heated. Heat may be provided by a variety of heating elements (not shown).

As aforementioned, the heater-head 116 is pivotally mounted to the distal end 130.

In this respect, the distal end 130 includes a pivot member such as pivot rod 176 similar to pivot rods 162, 164 and 170 and also having first and second ends 166 and 168, respectively. The heater-head 116 includes pivot member receiving members such as first 178 and second 180 bracket members. Each bracket member 178 and 180 includes a respective aperture (not shown). Bracket members 178 and 180 are respectively mounted to the second ends 160 of longitudinal members 154 and 156 with their respective apertures aligned so as to be hinged together by the first 166 and second 168 ends of pivot rod 176 respectively. In this way, the heater-head 116 and the proximal arm section 144 are pivotable about a pivot axis defined by the pivot rod 176.

With reference to FIGS. 6, 7, 8 and 9 the operation of the extendable heater 110 or support for heater a heater-head 116 will be described.

The accordion arm 114 is moveable by pivoting its arm sections 140, 142 and 144 about pivot joints 128, 137, 138 and 130. In this respect, the heater-head 116 is reciprocally moveable between a fully retracted position shown in FIG. 6 and a fully extended position shown in FIG. 8.

In the fully retracted position, shown in FIG. 6, the extendable accordion arm 114 is fully retracted or folded and the heater-head 116 is in close proximity to the wall-engaging member 112. Again here, this position is convenient when the heater 110 is not in use since the heater is in a fully retracted or recoiled position, which protects the heat projecting underside 174.

Figure 8:
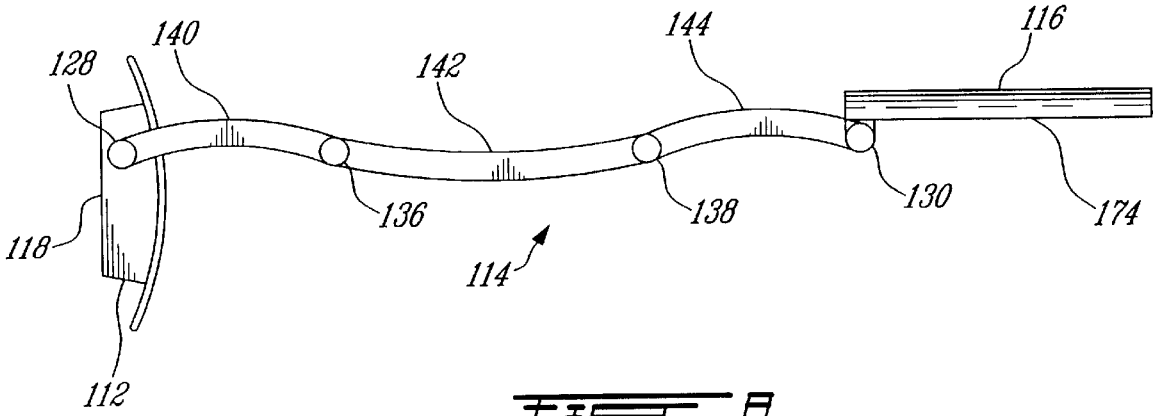
FIG. 8 is a side elevational view of the extendable heater of FIG. 5, shown in a fully extended position.
Figure 6:
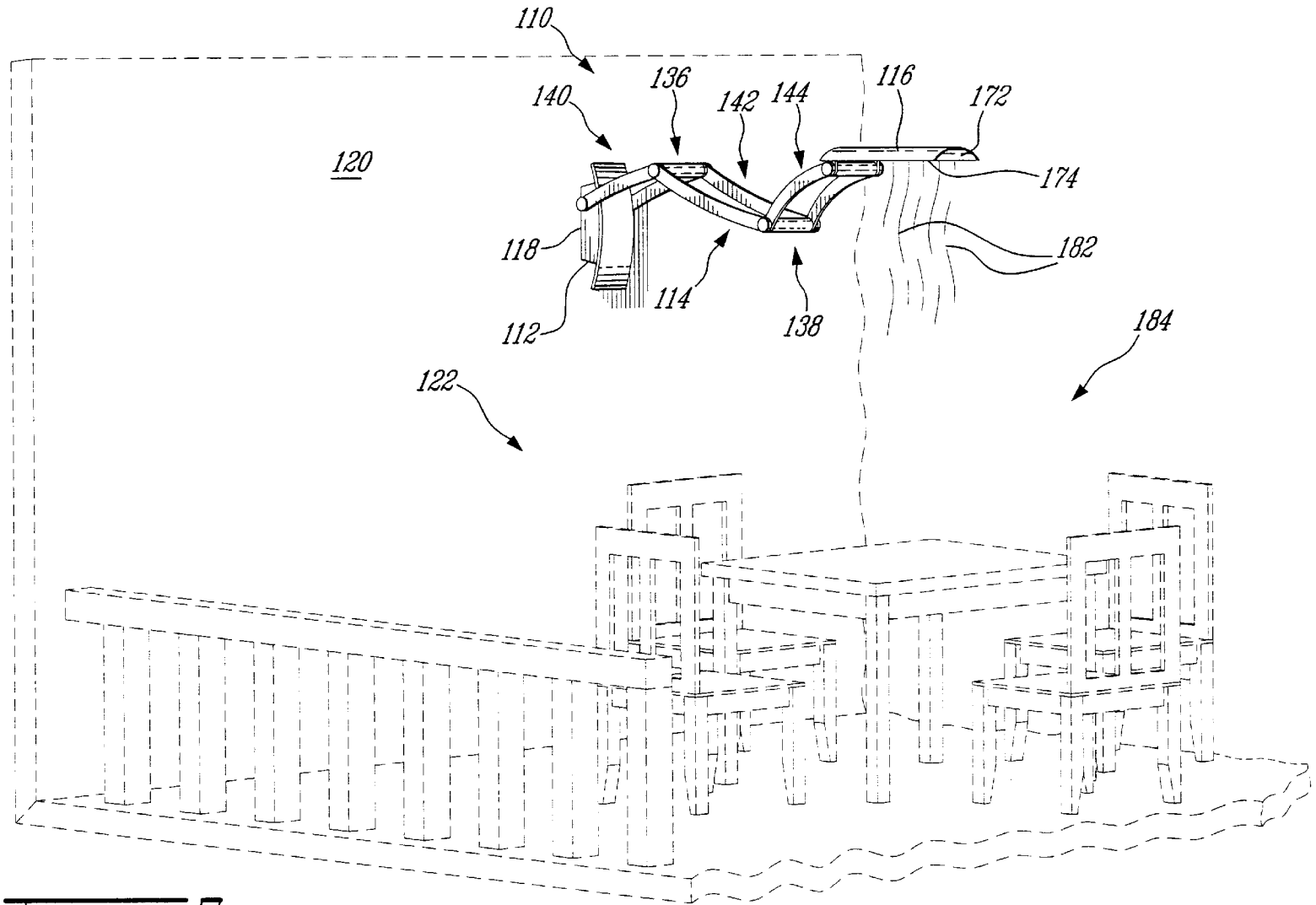

In the fully extended position shown in FIG. 8, the extendable accordion arm 114 is fully extended and the heater-head 116 is in the greatest possible distance away from the wall-engaging member 112. The foregoing distance will vary in accordance with the configuration and length of the extendable arm 114.

Figure 7:
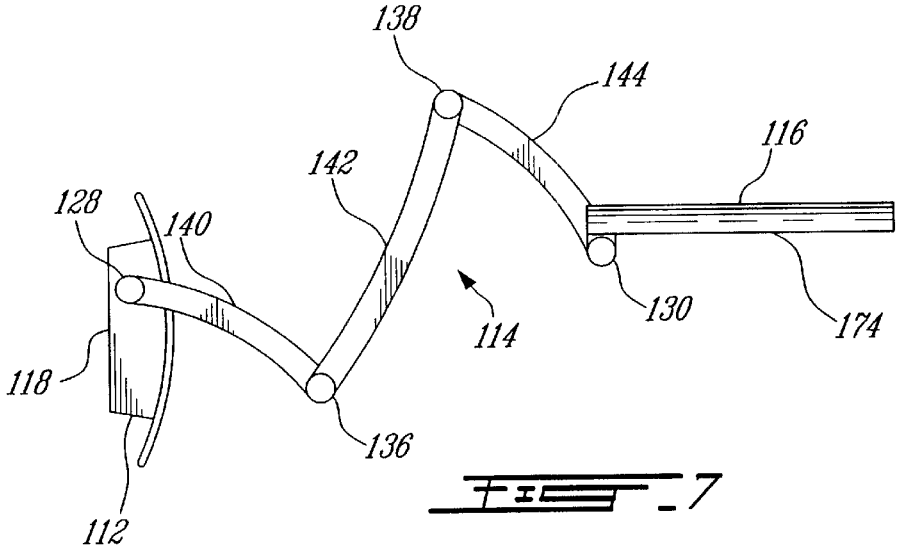
FIG. 7 is a side elevational view of the extendable heater of FIG. 5, shown in a partially extended position.

The user can move the heater-head 116 between the first and second positions by pulling or pushing the arm 114 so as to position arm 114 in a particular desired position, such as a partially retracted position as shown in FIG. 7 or the position shown in FIG. 9. Of course, a handle (not shown) may be provided on the arm 114 or heater-head 116 in order to move the heater-head 116. It must be noted that the pivotable connections at joints 136 and 138 and at proximate and distal ends 138 and 140 are provided with sufficient tension so as to maintain the extendable arm 114 and the heater-head 116 in a desired position.

Again here, it is also to be noted that while the appended drawings show the heater head 116 in a position generally parallel to the ground, the heater head 116 may be positioned in other suitable and desirable positions. The heater-head may be pivoted about the distal end 130 to radiate heat in different directions.

When is use and with particular reference to FIG. 9, the present extendable heater 110 or support for a heater 116 is mounted to a wall 120, by fixedly engaging the wall-engaging member 112 to the wall 120 by a variety of conventional ways. Advantageously, the extendable heater 110 is placed adequately high on the wall 120 so as to transmit heat, as shown by schematic waves 182, to a desired and specific area such as a table and chair assembly 184 for example, on a patio 122 or a terrace and the like.

In the example shown here, the heater-head 116 is positioned in a somewhat distant position from the wall-engaging member 112. The heater-head 116 will be moved depending on whether the user wishes to bring it closer or further from the area which is desired to be heated, such as the chair and table assembly 184.

An advantage of the present invention is that the extendable heater 10 or 110 disclosed herein can be fixed to a wall surface yet can be brought closer or pushed further away from the area which is desired to be heated.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described, hereinabove by way of preferred embodiments thereof; it can be modified, without departing from the spirit, scope and nature of the subject invention as defined in the appended claims.

What is claimed is:

1. A heater comprising:

a wall-engaging member mountable to a wall;

an extendable arm including proximate and distal ends, said proximate end being mounted to said wall-engaging member; said extendable arm including at least one pivot joint and at least two arm sections interconnected by said pivot joint; and a heater-head being mounted to said distal end of said extendable arm;

wherein said heater-head is reciprocally movable between a first position where said heater-head is in close proximity to said wall-engaging member and a second position where said heater-head is distant from said wall-engaging member.

2. A heater according to claim 1, wherein said proximate end is pivotally mounted to said wall-engaging member.

3. A heater according to claim 2, wherein said wall-engaging member includes a wall-engaging portion mountable to the wall, and an arm-receiving portion configured and sized to pivotally receive said proximate end.

4. A heater according to claim 3, wherein said proximate end includes a pivot member hingeably connecting said proximate end to said arm receiving portion.

5. A heater according to claim 4, wherein said arm-receiving portion includes a bracket for hinging said pivot member thereto.

6. A heater according to claim 4, wherein arm-receiving portion includes a longitudinal aperture, said pivot member being a pivot rod pivotally mounted in said longitudinal aperture.

7. A heater according to claim 4, wherein said proximate end includes an actuating assembly.

8. A heater comprising:

a wall-engaging member mountable to a wall;

an extendable accordion arm having proximate and distal ends, said proximate end of said extendable accordion arm being mounted to said wall-engaging member; said extendable accordion arm including at least one pivot joint and at least two arm sections interconnected by said pivot joint; and a heater-head mounted to said distal end of said extendable accordion arm.

9. A heater according to claim 8, wherein said at least one pivot joint includes a pivot member, said pivot member hingeably interconnecting said at least two arm sections.

10. A heater according to claim 9, said at least two arm sections include a proximate arm section mounted to said wall-engaging member and a distal arm section mounted to said heater-head.

11. A heater according to claim 9, wherein said pivot member includes a pivot rod and wherein each said arm section includes an aperture for pivotally receiving said pivot rod.

12. A heater according to claim 9, wherein said pivot joint includes an actuating assembly for pivoting said pivot member.

13. A heater according to claim 12, wherein said actuating assembly includes a pinion gear mounted to said pivot member, a worm gear in mutual interference engagement with said pinion gear and a pivot key member mounted to said worm gear.

14. A heater according to claim 13, wherein said key member is configured and sized to receive a pivot shaft assembly including a shaft member having a hook member at its distal end and a handle member at its proximate end, said hook member being so configured as to engage said key member.

15. A heater according to claim 1, wherein said heater-head is pivotally mounted to said distal end.

16. A heater according to claim 15, wherein said distal end includes a distal end pivot member hingeably interconnecting said distal end to said heater-head.

17. A heater according to claim 16, wherein said distal end includes an actuating assembly for pivoting said pivot member.

18. A heater according to claim 1, wherein said heater-head includes a housing and heating elements mounted to said housing.

19. A heater according to claim 1, wherein said heater-head is a gas heater-head.

20. A heater according to claim 1, wherein said heater-head is an electric heater-head.

21. A heater according to claim 1, wherein said extendable arm is an accordion folding arm.

22. An extendable heater comprising:

a proximal section having a proximate end including a wall-engaging member mountable to a wall, and a distal end; and a distal section including a heater-head for projecting heat, said distal section pivotably mounted to said distal end of said proximate section, wherein said heater-head is reciprocally movable between a first position wherein said heater-head is in close proximity to said wall-engaging member and a second position wherein said heater-head is distant from said wall-engaging member.

23. A heater according to claim 22, wherein said one end of said proximate section is pivotally mounted to said wall-engaging member.

24. A support for a heater comprising:

a wall-engaging member mountable to a wall; and an extendable arm including proximate and distal ends, said proximate end being mounted to said wall-engaging member, said distal end being so configured as to receive the heater, said extendable arm including at least one pivot joint and at least two arm sections interconnected by said pivot joint, wherein said extendable arm is reciprocally movable between a first position wherein said extendable arm is fully retracted and a second position wherein said arm is fully extended.

25. A heater according to claim 22, wherein said heater-head is housed within said distal section.

26. A heater according to claim 22, wherein said distal section includes one end mounted to said proximate section and another end mounted to said heater-head.

27. A heater according to claim 22, wherein said heater-head is pivotally mounted to said distal section.

28. A heater comprising:

extendable means having a proximate end and a distal end; said extendable arm including at least one pivot joint and at least wo arm sections interconnected by said pivot joint;

means for mounting said proximate end to a wall surface;

heat generating means mounted to said distal end;

wherein said extendable means being so designed as to reciprocally move said heat generating means between a first position wherein said heat generating means are in close proximity to said mounting means and a second position wherein said heat generating means are distant from said mounting means.

* * * * *